United States Patent [19]

Berneking et al.

[11] Patent Number: 4,827,271

[45] Date of Patent: May 2, 1989

[54] DUAL FREQUENCY MICROSTRIP PATCH ANTENNA WITH IMPROVED FEED AND INCREASED BANDWIDTH

[75] Inventors: William D. Berneking; Edward A. Hall, both of St. Louis, Mo.

[73] Assignee: McDonnell Douglas Corporation, St. Louis, Mo.

[21] Appl. No.: 934,478

[22] Filed: Nov. 24, 1986

[51] Int. Cl.[4] ..... H01Q 1/38

[52] U.S. Cl. ..... 343/700 MS; 343/846

[58] Field of Search ..... 343/700 MS, 829, 830, 343/846; 333/128

[56] References Cited

U.S. PATENT DOCUMENTS

| | | | |
|---|---|---|---|
| 4,089,003 | 5/1978 | Conroy | 343/700 MS |
| 4,329,689 | 5/1982 | Yee | 343/700 MS |
| 4,414,550 | 11/1983 | Tresselt | 343/700 MS |
| 4,660,048 | 4/1987 | Tresselt | 343/700 MS |
| 4,660,048 | 4/1987 | Doyle | 343/700 MS |

FOREIGN PATENT DOCUMENTS

| | | | |
|---|---|---|---|
| 95407 | 6/1983 | Japan | 343/700 MS |
| 181706 | 10/1984 | Japan | 343/700 MS |
| 2005922 | 4/1979 | United Kingdom | 343/700 MS |

*Primary Examiner*—William L. Sikes
*Assistant Examiner*—Michael C. Wimer
*Attorney, Agent, or Firm*—Rogers, Howell, Moore & Haferkamp

[57] ABSTRACT

A dual frequency stacked microstrip patch antenna is comprised of a pair of circular radiating patches separated by a layer of dielectric, the two upper patches being further separated by another layer of dielectric from a pair of separated ground planes. A modal shorting pin extends between the patches and ground planes, and the patches are fed through a pair of feed pins by a backward wave feed network. A pair of pear-shaped holes in the lower patch through which the feed pins pass balance the impedance between the patches and result in an extended bandwidth.

11 Claims, 2 Drawing Sheets

FIG. 1.
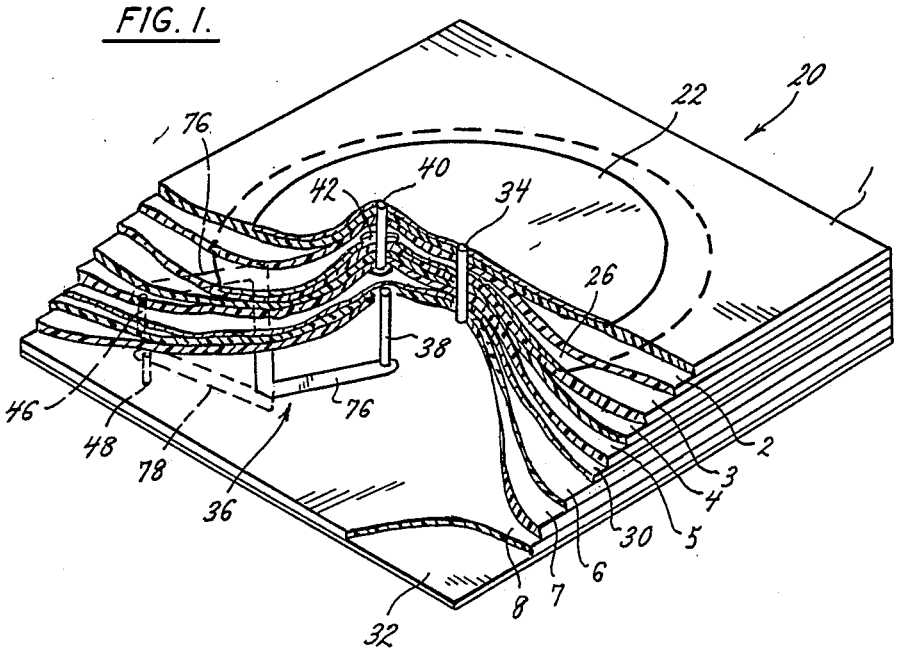
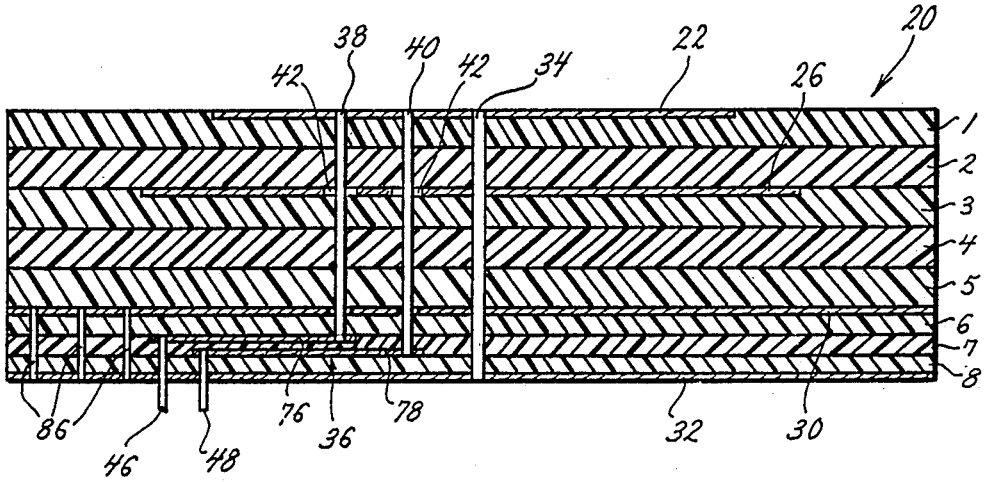
FIG. 2.

DUAL FREQUENCY MICROSTRIP PATCH ANTENNA WITH IMPROVED FEED AND INCREASED BANDWIDTH

BACKGROUND AND SUMMARY OF THE INVENTION

Circular patch microstrip antennas are well known in the art and have many advantages which make them particularly adapted for certain applications. In particular, a stacked microstrip patch antenna is relatively inexpensive and easily manufactured, rugged, readily conformed to surface mount to an irregular shape, has a broad reception pattern, and can be adapted to receive multiple frequencies through proper configuration of the patches.

One particular application includes utilizing a stacked microstrip patch antenna for receiving signals transmitted by the global positioning system (GPS) satellites on an air frame. In this application, the antenna must operate at dual frequencies and be physically small enough to be utilized in an array. Furthermore, the antenna should provide approximately hemispherical coverage and have its pattern roll-off sharply between 80° and 90° from broadside to reject signals from emitters on the horizon. Because of its conformability, the antenna is uniquely adapted for mounting to the host vehicle which could be double curved, and its electrical characteristics provide a minimum impact on radar signature. The antenna must provide at least a 2% frequency bandwidth and circular polarization at both GPS frequencies. The antenna is ideal for use in a multi-element array for adaptive processing; a method of automatically steering nulls toward interferring signals. For this application, the antenna must provide at least 5% frequency bandwidth for good performance.

Some of the stacked microstrip antennas which are available in the prior art include the antenna disclosed in U.S. Pat. No. 4,070,676 which has square shaped microstrip patches stacked for dual frequency. However, based on the inventors' experience, this antenna does not exhibit the necessary frequency bandwidth for utilization as a GPS adaptive antenna. Still another microstrip patch antenna is disclosed at p. 255 of the 1984 *IEEE Antennas and Propagation Digest* which utilizes a triple frequency stacked microstrip element. However, once again the antenna bandwidth is not large enough to enable its use in a GPS adaptive antenna application. Still another stacked microstrip patch antenna is disclosed at p. 260 of the 1978 *IEEE Antennas and Propagation Digest* and this antenna has a pair of circular disks stacked one atop the other with a single feed extending through a hole in the lower disk and physically connected to the upper disk. However, as with the other antennas, this antenna does not exhibit the necessary frequency bandwidth to be utilized in a GPS adaptive antenna application.

The inventors herein have succeeded in developing an improved feed for a dual frequency stacked circular microstrip patch antenna which increases the bandwidth including a wider frequency operating range within a prescribed VSWR, and a wider operating range for a prescribed antenna gain which permits its use with a GPS system, and especially with an adaptive nulling processor for interference rejection. The wider bandwidth permits the processor to develop deep nulls over a wide frequency range as is necessary for this system. The improved, wider bandwidth also minimizes the deleterious effects caused by manufacturing tolerances and environmental conditions which would otherwise shift a narrower band antenna out of the desired frequency range.

The antenna of the present invention is comprised of eight boards, some of which have a copper layering on one or both sides thereof, and others of which have no copper and are used as spacers. Furthermore, the boards themselves may be of varying thicknesses although in the preferred embodiment the top five boards are substantially the same thickness and the bottom three boards are of substantially the same thickness but smaller than the top five boards. From top to bottom, the eight boards can be generally described as follows:

Board No. 1 has an upper layer of copper configured in a circle to form the upper patch.

Board No. 2 is a layer of dielectric with no copper on either side.

Board No. 3 has an upper layer of copper to form the lower patch and has a pair of pear-shaped holes to accommodate insertion of feed pins.

Board No. 4 is a layer of dielectric with no copper on either side.

Board No. 5 is a layer of dielectric with no copper on either side.

Board No. 6 is a dielectric with a layer of copper along its upper surface with a pair of circles cut out on its upper side for the feed pins to pass through.

Board No. 7 is a dielectric of reduced thickness having a copper trace on the upper and lower sides forming the backward wave coupler.

Board No. 8 is a dielectric of reduced thickness with copper layering on the bottom except for two circular patches to accommodate termination and feed connections for the backward wave coupler.

In addition to the modal pin which interconnects both the upper and lower patches to the two ground planes, a number of cavity pins extend between the ground planes surrounding the two feed connections. Also, two pins connect the upper patch to the backward wave coupler.

By bonding these boards together, a rigid structure is formed which can be conformed to fit the surface on which the antenna is to be mounted and yet provide a low profile. Furthermore, with the feed design of the present invention, an increased bandwidth is achieved which enables the antenna to be used in a GPS system.

While the principal advantages and features of the present invention have been briefly described, a more complete understanding of the invention may be obtained by referring to the drawings and the Detailed Description of the Preferred Embodiment which follows.

BRIEF DESCRIPTION OF THE DRAWINGS

FIG. 1 is a perspective of the antenna partially broken away to detail the various layers of the antenna;

FIG. 2 is a cross-sectional view of the antenna which gives further detail on the various layers used to form the antenna.

DETAILED DESCRIPTION OF THE PREFERRED EMBODIMENT

Figure 3:
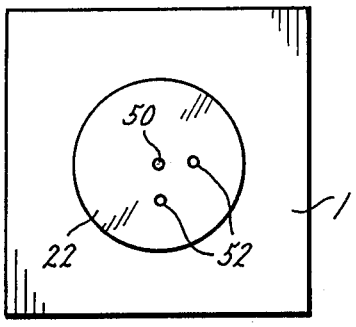
FIGS. 3–10 depict individual boards used to form the antenna.

As shown in FIG. 1, the principal elements of the present invention include an upper microstrip radiating patch 22 separated by dielectric spacers 1 and 2 from a lower microstrip radiating patch 26. Dielectric spacers 3, 4, 5 and 6, 7, 8 separate the lower patch 26 from an upper ground plane 30 and a lower ground plane 32, respectively. A modal shorting pin 34 interconnects and extends between each of the upper patch 22, lower patch 26, upper ground plane 30, and lower ground plane 32. A backward wave feed network 36 feeds the patches 22, 26 through a pair of feed pins 38, 40 which extend through pear-like holes 42 (the second hole not being shown in FIG. 1) in lower patch 26. One port 46 provides the connection for signal transmission and another port 48 provides a termination point for a dummy load (not shown).

Figure 7:
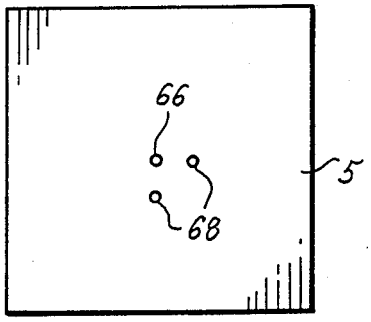
Figure 4:
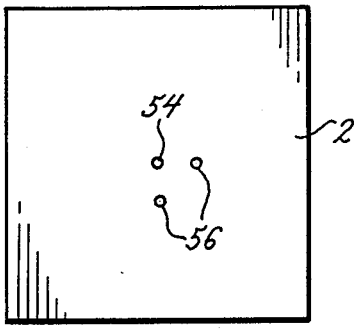
Figure 8:
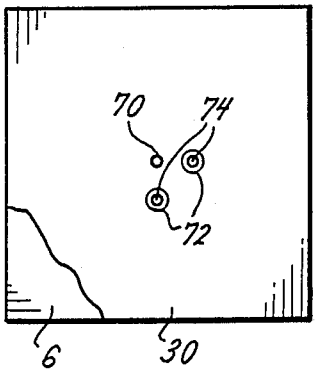
Figure 5:
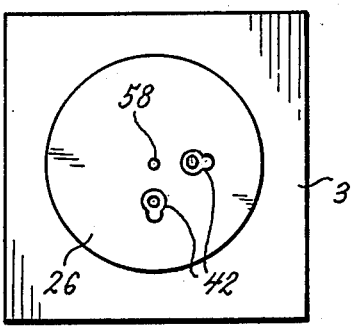
Figure 9:
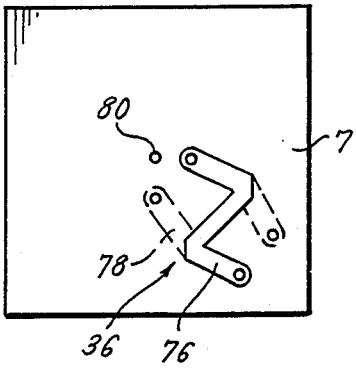
Figure 6:
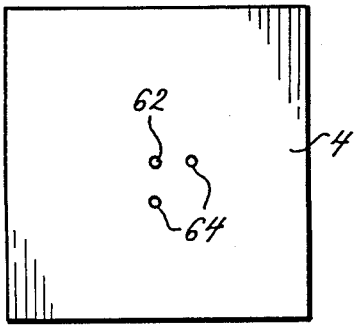
Figure 10:
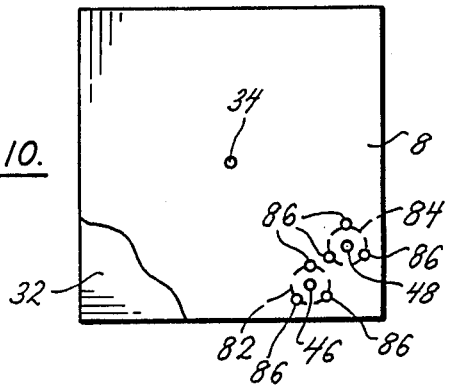

As shown in greater detail in FIGS. 2 and 3–10, the antenna 20 can be constructed from eight boards with copper layering thereon, the copper layering being etched off during manufacture as desired to form the proper board. In the preferred embodiment, the top five boards all have a nominal thickness of 0.0625 inches and can be made from R. T. Duroid with a relative dielectric constant of 2.33. Other values of dielectric constant may be used to vary pattern shape. For convenience, the boards have been numbered 1–8 starting with the upper board. As shown in FIGS. 2 and 3–10, Board No. 1 has an upper copper patch of approximately 1.45 inch radius with a center hole 50 and two feed pin holes 52 located at a nominal 0.59 inch radius. Board No. 2 has no copper layering and has a center hole 54 and two feed pin holes 56 located at a nominal 0.59 inch radius. Board No. 3 has an upper circular patch of copper layering to form the lower patch 26 with a nominal 1.73 inch radius, a center hole 58 and two pear-shaped holes 60 having a width of 0.18 inch and a length of 0.25 inch with their larger ends closer to the center of patch 26 and radially aligned with the center hole 58. Board No. 4 has no copper layering, with a center hole 62 and two feed pin holes 64. Board No. 5 has no copper layering with a center hole 66 and a pair of feed pin holes 68. Board No. 6 has an upper side with copper layering covering almost the entire upper surface to form the upper ground plane 30, with a center hole 70 and a pair of circular patches 72 cut from the copper layering to avoid contact with feed pins 38, 40, and a pair of feed pin holes 74. Board No. 7 has an upper Z-like shape copper trace 76 along its upper surface and an offset copper trace 78 along its lower surface to form the backward wave feed network 36. Each trace 76, 78 has a line width of approximately 0.025 inches, the traces, 76, 78 having an overlap length of 1.32 inches. Also, a center pin hole 80 extends through Board No. 7. Board No. 8 includes a lower copper layer which forms the lower ground plane 32 with a pair of circular cutouts 82, 84 to accommodate the two connections 46, 48 for backward wave feed network 36 as best shown in FIG. 1. Additionally, a trio of cavity pins 86 are representationally shown on Board No. 8 in FIG. 10 surrounding each circular hole cutout 82, 84 and which extend between ground planes 30, 32 to help isolate these connections.

OPERATION

The antenna of the present invention operates as a circular microstrip patch radiator. A shorting or modal pin in the center of each patch forces the element into the $TM_{01}$ mode. This modal pin connects the center of each radiating patch to the ground plane. When the upper patch is resonant it uses the lower patch as a ground plane. The lower patch operates against the upper ground plane and acts nearly independently of the upper element. The antenna is fed through two feed pins which are oriented at right angles to each other to excite orthogonal modes and are 90° out of phase to achieve circular polarization. The bandwidth of the antenna is increased by increasing the thickness of the dielectric material between the radiating patches.

The input impedance is controlled by placement of the feed pins along the radius of each circular patch. Feeding at a larger radius from the center of each patch causes a higher input impedance. As the upper patch has a smaller radius than the lower patch, and the feed pins are parallel to each other and perpendicular to each of the two patches, ordinarily different input impedances would be obtained for the patches. As the widest bandwidth match for both frequencies in a GPS system occurs when the input impedance circles 50 ohms within an acceptable VSWR at each resonance, and a 50 ohm input impedance corresponds to approximately one-third of the patch radius, it is desired to locate the feed pins near one-third of the radius. This is achieved by physically connecting the upper ends of the feed pins at the one-third radius point to the upper patch, and by utilizing modified feed-through holes which are pear-shaped and capacitively coupling the feed pins to the lower patch to simulate connection of the feed pins further from the center than actual. There is also capacitive coupling between the upper and lower patch that excites the lower patch. These pear-shaped holes are located by providing a first feed-through hole at the radius needed to feed the upper patch at the 50 ohm input point, and then forming a second smaller hole in the lower patch at the radius to feed it for the 50 ohm input impedance, these holes overlapping to form the pear shape. By utilizing these modified feed pin holes, a 10–18% increase in bandwidth at both resonances is achieved.

The backward wave coupler network which forms the feed connection between the feed pins and signal connection greatly extends the frequency bandwidth defined by allowable input in VSWR. The backward wave coupler provides an equal power split and a 90° phase shift between the output ports. These signals, when fed to the patches by pins separated by 90°, cause the antenna to radiate circular polarization. Furthermore, the backward wave coupler also routes reflected signals due to impedance mismatch into an isolated port where a dummy load such as a resistor can dissipate the reflected power to minimize interference with the radiated signal. For the backward wave coupler to dissipate all reflected power, its two output ports must drive identical impedances. This condition exists because the two feed points on the patch are orthogonal and isolated from each other, forming equal and independent impedances. The backward wave coupler when combined with the dual feed pin feed for circular polarization results in an input VSWR of 1.5:1 or less over a nearly octave bandwidth of 1.2:2 GHz. A VSWR of 1.7:1 or lower is usually very acceptable.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In a multiple frequency stacked microstrip patch antenna, said antenna including at least two spaced apart radiating patches and a ground plane, one of said patches being stacked substantially vertically above the other and the ground plane, said patches being sized and spaced to resonate at different, separated, frequencies, the improvement comprising a backward wave coupler feed means including a pair of feed-through pins for electrical connection to the patches, the feed pins being physically connected to the upper patch and capacitively coupled to the lower patch, and the lower patch having means defining a pair of feed-through holes through which said pins extend, said holes being substantially pear-shaped with a larger end and positioned with the larger end closest to the center of their associated patch to thereby match the input impedances to each of said patches at their respective operating frequencies and improve their respective bandwidths.

2. The antenna of claim 1 wherein the pins pass through the holes nearer their said larger end.

3. The antenna of claim 2 wherein the pins and holes are spaced at substantially 90° around the center of the patches.

4. The antenna of claim 3 wherein the backward wave coupler comprises a pair of conductive strips, said strips being spaced apart by a dielectric, one end of each of said strips being connected to a feed pin, and the other end of one of said strips being connected to a dummy load.

5. In a multiple frequency stacked microstrip patch antenna, said antenna including at least two spaced apart radiating patches and a ground plane, one of said patches being stacked substantially vertically above the other and the ground plane, said patches being sized and spaced to resonate at different frequencies, a feed means comprising a pair of feed pins extending through holes in the lower patch for capacitative coupling thereto and terminating in a physical electrical connection to the upper patch, the improvement comprising means to match the input impedances to each of the patches at their respective operating frequencies to thereby improve their respective bandwidths comprising a modified shape for said feed-through holes, said modified shape being substantially pear like with a larger end, the larger end of each hole being oriented closer to the center of their associated patch.

6. The antenna of claim 6 wherein the longitudinal axes of the pear-shaped holes are radially aligned with the center of the lower patch and the feed-through pins extend through said larger ends.

7. The antenna of claim 6 wherein each patch is shaped to resonate at one of the GPS frequencies.

8. The antenna of claim 7 wherein each of said holes has an arcuate portion substantially defined by a circle, said feed pins extending through said holes at substantially the center of the circles.

9. The antenna of claim 8 wherein each of said holes has a second arcuate portion substantially defined by a circle having a second, smaller radius than the radius of said first circle, said first and second circles at least partially overlapping.

10. The antenna of claim 9 wherein the holes are positioned with the circle the largest radius being closest to the center of their associated patch.

11. The antenna of claim 10 wherein said holes are each solely comprised of the first and second arcuate portions.

* * * * *